United States Patent [19]

Fukuyama et al.

[11] Patent Number: 4,692,573

[45] Date of Patent: Sep. 8, 1987

[54] INTERLOCK PUSH-PUSH SWITCH DEVICE

[75] Inventors: Takahiko Fukuyama, Gifu; Seiji Hori, Aichi; Yoshihiro Ota; Yoshikazu Hayashi, both of Gifu, all of Japan

[73] Assignee: Kabushiki Kaisha Tokai Rika Denki Seisakusho, Aichi, Japan

[21] Appl. No.: 809,738

[22] Filed: Dec. 17, 1985

[30] Foreign Application Priority Data

Dec. 17, 1984 [JP] Japan ..... 59-190994[U]
Dec. 21, 1984 [JP] Japan ..... 59-194883[U]

[51] Int. Cl.[4] ..... H01H 9/20

[52] U.S. Cl. ..... 200/50 C; 200/5 E; 200/153 J

[58] Field of Search ..... 200/153 J, 133 JH, 50 C, 200/5 C, 5 E, 5 B

[56] References Cited

U.S. PATENT DOCUMENTS

| | | | |
|---|---|---|---|
| Re. 27,963 | 4/1974 | Schadow | 200/153 J |
| 4,385,214 | 5/1983 | Sullivan | 200/5 E |
| 4,575,590 | 3/1986 | Hattori et al. | 200/153 J X |

*Primary Examiner*—A. D. Pellinen
*Assistant Examiner*—Morris Ginsburg
*Attorney, Agent, or Firm*—Finnegan, Henderson, Farabow, Garrett and Dunner

[57] ABSTRACT

A switch device comprises a dual push-push type switch device wherein each switch includes a cam protrusion that engages a downwardly inclined end portion of a lock pin when the switch is in a release position so that in the event of the depression of both switches simultaneously the top end portion of each of the lock pins slides over the cam protrusion of a respective operating piece.

6 Claims, 6 Drawing Figures

INTERLOCK PUSH-PUSH SWITCH DEVICE

FIELD OF THE INVENTION

This invention relates to a switch device having a pair of operating pieces which are depressed similarly as in the case of a so-called dual push-push type swich device.

BACKGROUND OF THE INVENTION

In a dual push-push type switch device, as is well known in the art, a pair of lock pins are provided on the sides of the bases in correspondence to heart-shaped cam parts provided respectively for a pair of operating pieces. In operation, whenever each operating piece is pushed the respective cam part is engaged with the lock pin to hold the operating piece at the push position thereof. Upon release of the engagement the operating piece is returned to its original position. These operations are repeated alternately.

In addition, a movable operating member is provided between the pair of lock pins in such a manner that, when one of the operating pieces is pushed with the other operating piece held at its push position, the operating member is moved by the lock pin provided for the is forcibly disengaged to return the other operating piece to its original position.

When, in the switch device thus constructed, the pair of operating pieces held at the original positions are pushed simultaneously, the top end portions of the lock pins tend to move along the cam grooves provided around the cam protrusions of the cam parts while abutting against the cam protrusions. In this way, the operating member between the lock pins is held in balance as it is pushed by the top end portions. If, under this condition, the two operating pieces are further pushed, since the lock pins have no relief space, the additional pushing force may damage the cam protrusions which are abutted against the top end portions of the lock pins, or deform the top end portions of the lock pins. This difficulty is liable to occur as the switch device is miniaturized.

OBJECTS AND SUMMARY OF THE INVENTION

An object of the present invention is a reliable switch device.

Another object of the present invention is a dual push-push type switch device wherein simultaneous depression of two operating pieces will not damage the switch.

A further object of the present invention is a dual push-push type switch device wherein simultaneous depression of two operating pieces will not deform lock pins.

Still another object of the present invention is a dual push-push type switch device wherein simultaneous depression of two operating pieces will not damage cam protrusions of cam parts.

These and other objects are accomplished by a switch device comprising a first base and a first operating piece having a portion received in the first base, the first operating piece being movable with respect to the first base between an actuated position and a release position, a second base and a second operating piece having a portion received in the second base, the second operating piece being movable with respect to the second base between an actuated position and a release position, means for biasing the first operating piece relative to the first base and the second operating piece relative to the second base to the respective release positions therefor, a first cam part on the first operationg piece including a first cam protrusion and a first cam groove, the first cam protrusion having a first cam surface inclined obliquely a second cam part on the second operating piece including a second cam protrusion and a second cam groove, the second cam protrusion having a second cam surface inclined obliquely a first lock pin having a first base portion received in the first base a first top end portion adapted for movement in the first cam groove and engagement with and movement along the first cam surface during movement of the first operating piece between the release position and the actuation position thereof, a second lock pin having a second base portion received in the second base and a second top end portion adapted for movement in the second cam groove and engagement with and movement along the second cam surface during movement of the second operating piece between the release position and the actuated position thereof, an operating member having a first end in abutment with the first lock pin and a second end connected to the second lock pin, the operating member for biasing the lock pin of one of the operating pieces to disengage the top end portion thereof from the cam protrusion of the cam part associated with the biased lock pin in response to the movement of the other of the operating pieces from the release position to the actuated position thereof; and damage proof means for allowing said top end portion of said lock pin to move over said cam protrusion of said cam part.

BRIEF DESCRIPTION OF THE DRAWINGS

The manner by which the above objects and other objects, features, and advantages of the present invention are attained will become completely apparent from the following detailed description when considered in view of the drawings, wherein.

DETAILED DESCRIPTION OF THE PREFERRED EMBODIMENTS

Figure 2:
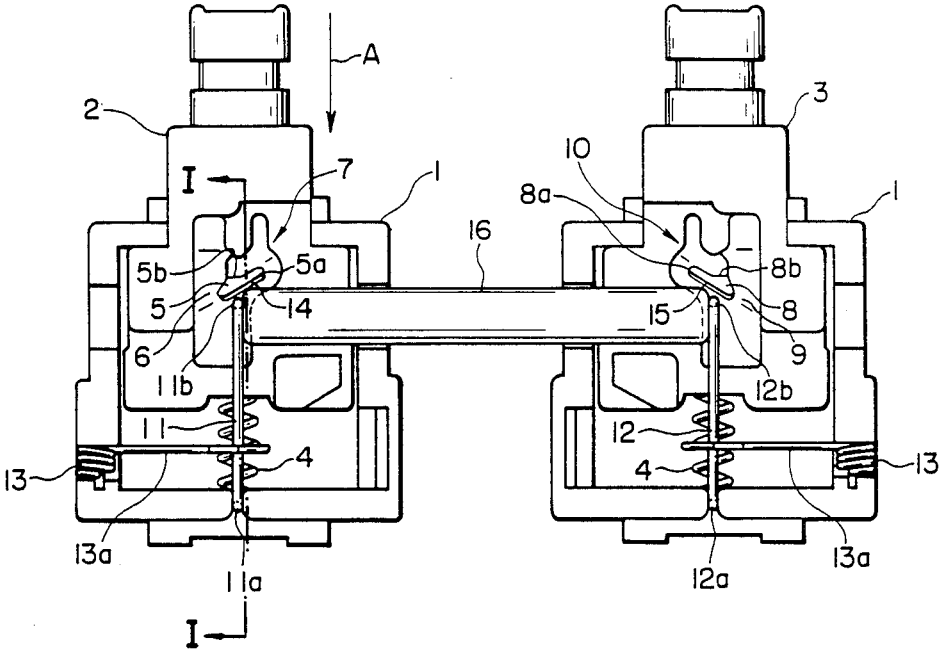
FIG. 2 is a front-view showing the arrangement of the switch according to the present invention.

An embodiment of a dual push-push type switch device according to the present invention is shown in FIG. 2. A pair of box-shaped bases 1, 1 are juxtaposed in a case (not shown); and are provided with a pair of operating pieces 2, 3. The lower half of each of the operating pieces 2, 3 is received in the respective base 1, and the upper half protrudes through the upper wall of the base 1 extends above the base 1. The operating pieces 2 and 3 can be pushed in the direction of the arrow A.

A compression coil spring 4 is interposed between the operating pieces 2 and the lower wall of its base 1. Similarly, a compression coil spring 4 is interposed between the operating piece 3 and the lower wall of its base 1. In this manner, the operating pieces 2 and 3 are urged upwardly by the coil springs 4 to their original positions.

As shown in FIG. 2, the operating piece 2 has a so-called heart-shaped cam part 7 on its front side. The cam part 7 has a substantially heart-shaped cam groove 6 around a cam protrusion 5. The cam protrusion 5 has a sloped part 5*a* which protrudes in such a manner that its inclination increases upwards to the right. An engaging part 5*b* extends substantially to the left of the sloped part 5*a*.

The operating piece 3 has a cam part 10 on its front side. The cam part 10 is symmetrical with the cam part 7; that is, the cam part 10 is heart-shaped, having a cam protrusion 8, and a substantially heart-shaped cam groove 9 around it. The cam protrusion 8 has a sloped part 8*a* which protrudes in such a manner that its inclination increases upwards to the left, and an engaging part 8*b* extends substantially to the right.

Further, in FIG. 2, a pair of lock pins 11 and 12 confront the cam parts 7 and 10, respectively. Each lock pin is formed by bending the upper and lower end portions of a metal wire so that it is substantially U-shaped. The lock pins 11 and 12 are so arranged that the lower end portions, namely its base end portions 11*a* and 12*a*, are inserted in the lower walls of the bases 1. The upper end portions, namely the top end portions 11*b* and 12*b* are movable along the cam grooves 6 and 9 of the cam parts 7 and 10, respectively. Twist coil springs 13 are mounted on the lower end portions of the side walls of the bases 1. The end portions 13*a* of the coil springs 13 abut against the middle parts of the lock pins 11 and 12 so that the lock pins 11 and 12 are pushed towards the operating pieces 2 and 3 by the coil springs 13 and in a direction toward to each other.

When the operating pieces 2 and 3 are held at the upper original positions, the top end portions 11*b* and 12*b* of the lock pins 11 and 12 are positioned below the cam protrusions 5 and 8 of the cam parts 7 and 10, respectively. (See FIG. 1) When the operating pieces 2 and 3 are pushed, the cam actions of the cam parts 7 and 10 move the top end portions 11*b* and 12*b* along the cam grooves 6 and 9 to engage with the engaging parts 5*b* and 8*b* of the cam protrusions 5 and 8. When the operating pieces 2 and 3 are pushed again, the top end portions 11*b* and 12*b* are disengaged from the engaging parts 5*b* and 8*b*and return the operating pieces 2 and 3 to their original positions.

Figure 1:
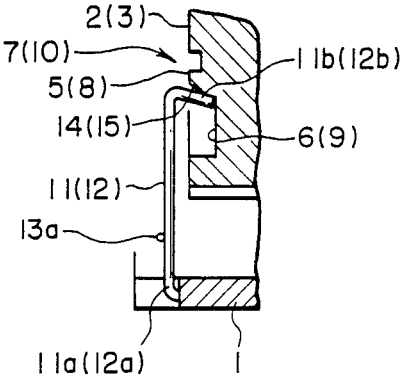
FIG. 1 is a cross-sectional side view of a portion of the switch device of FIG. 2 taken along the line I—I.

As shown in FIG. 1, sloped surfaces 14 and 15 are formed in the parts of the peripheral surfaces of the cam protrusions 5 and 8 which confront with the top end portions 11*b* and 12*b* of the lock pins 11 and 12 when the operating pieces 2 and 3 are returned to the original positions. The sloped surfaces 14 and 15 extend upwardly to the right and upwardly to the left, respectively. The top end portions 11*b* and 12*b* of the lock pins 11 and 12 are also inclined towards the cam grooves 6 and 9, as shown in FIG. 1.

As further shown in FIG. 2, a bar-shaped operating member 16 is set between the lock pins 11 and 12 of the bases 1 in such a manner that it is movable to the right and left therebetween. The right and left ends thereof abut against the top end portions 11*b* and 12*b* of the lock pins 11 and 12, respectively. Stationary contacts (not shown) are provided on the inner surfaces of the rear walls of the bases 1 and movable contacts are provided on the rear surfaces of the operating pieces 2 and 3 so as to be moved into and out of engagement with the stationary contacts, respectively. The stationary and movable contacts form switches. These switches are turned on only when the operating pieces are held at the pushed positions.

The operation of the dual push-push type switch device thus constructed will be described.

Under the condition that the operating pieces 2 and 3 are held at the original positions, respectively, as shown in FIGS. 2, only the operation of operating piece 2 will be described as the description thereof can be equally applied to the case where the right operating piece 3 is operated.

Upon depression of the operating piece 2 in the direction of the arrow A the lock pin 11 is turned about its base end portion 11*a*. That is, the top end portion 11*b* is moved from below the cam protrusion 5 along the cam groove 6 to the upper right side of the cam protrusion 5 while pushing the operating member 16 to the right. With release of the depression, when the operating piece 2 is slightly returned in the direction opposite to the direction of the arrow A by the elastic force of the compression coil spring 4, the top end portion 11*b* of the lock pin 11 is engaged with the engaging part 5*b* of the cam protrusion 5. As a result, as shown in FIG. 3, the operating piece 2 is held at the push position by the lock pin 11.

When the operating piece 2 is pushed again under this condition, the top end portion 11*b* of the lock pin 11 is disengaged from the engaging part 5*b* of the cam protrusion 5 and is moved upwards to the left along the cam groove 6. Upon release of the depression of the operating piece 2, the piece 2 is returned to the original position by the elastic force of the compression coil spring 4 while the top end portion 11*b* of the lock pin 11 is moved along the cam groove 6 to return to below the cam protrusion 5, as shown in FIG. 2.

The case where one of the operating pieces, e.g., the left operating piece 2, is held at the pushed position, and the other operating piece, the right operating piece 3, is operated will now be described.

Figure 3:
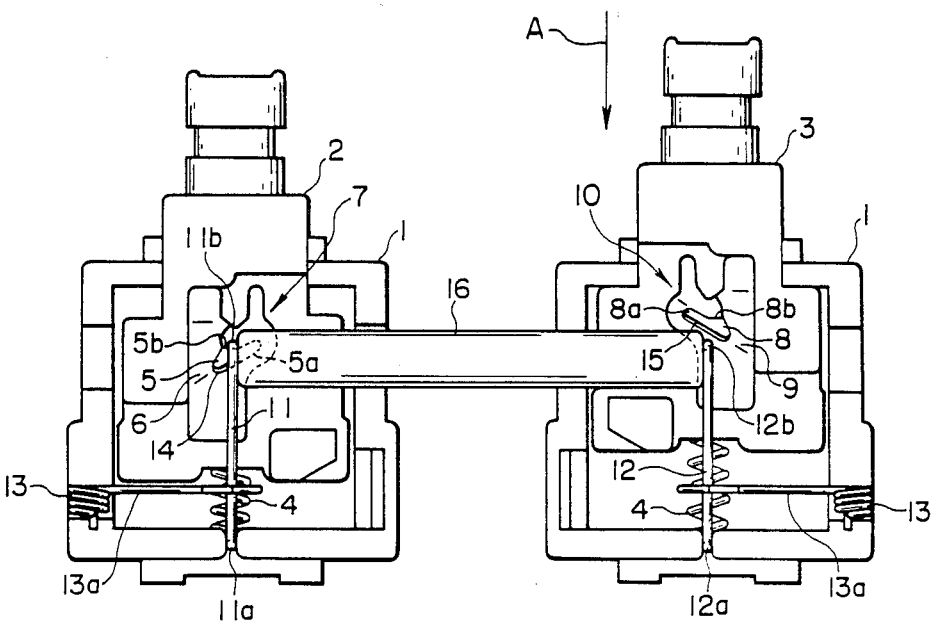
FIG. 3 is another front view of the switch of FIG. 1 showing a result of operation thereof.

When the operating piece 3 held as shown in FIG. 3 is slightly pushed in the direction of the arrow A, the top end portion 12*b* of the right lock pin 12 tends to move along the cam groove 9 upwards to the left while pushing the operating member 16 to the left. Because of the movement of the operating member 16 to the left, the top end portion 11*b* of the left lock pin 11 is pushed to the left, so that the top end portion 11*b* is forcibly disengaged from the engaging part 5*b* of the cam protrusion 5. As a result, the left operating piece 2 is returned to the original position by the elastic force of the compression coil spring 4. When, under this condition, the operating piece 3 is further, depressed the top end portion 12*b* of the lock pin 12 is engaged with the engaging part 8*b* of the cam protrusion 8.

The case where both the operating pieces 2 and 3 held at their original positions, as shown in FIG. 2, are pushed simultaneously will now be described.

Figure 4:
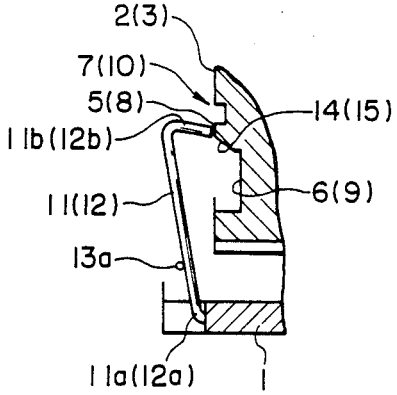
FIG. 4 is a cross-sectional side view similar to FIG. 1 of a portion of the switch shown in FIG. 2 when the switch is depressed.

When the operating pieces 2 and 3 are pushed simultaneously, the top end portions 11*b* and 12*b* of the lock pins 11 and 12 move along the cam grooves 6 and 9 from below the cam protrusions 5 and 8, so that the top end portions 11*b* and 12*b* are held in balance with the operating member 16 being pushed by the lock pins 11 and 12. When the operating pieces 2 and 3 are further pushed, the top end portions 11*b* and 12*b* of the lock pins 11 and 12 are moved over the cam protrusions 5 and 8 as shown in FIG. 4, respectively, so that the operating pieces 2 and 3 can be pushed, because the top end portions 11*b* and 12*b* are bent to incline, and the lower surface of the cam protrusions 5 and 8 are sloped.

In the above-described embodiment, when the operating pieces are pushed simultaneously, the top end portions 11*b* and 12*b* of the lock pins 11 and 12 are moved over the cam protrusions 5 and 8 so that the operating pieces can be pushed. Therefore, in the switch device of the present invention, unlike the conventional one, the cam protrusions 5 and 8 are not damaged by the top end portions 11*b* and 12*b* of the lock pins 11 and 12, respectively, and the top end portions 11*b* and 12*b* are not deformed.

In the above-described embodiment, the sloped surfaces 14 and 15 are formed on the cam protrusions 5 and 8, respectively and the top end portions 11*b* and 12*b* of the lock pins 11 and 12 are inclined. However either the sloping of the surfaces 14 and 15 or the inclination of the end portions 11*b* and 12*b* will suffice.

As is apparent from the above description, the part of the peripheral surface of each cam protrusion which confronts with the top end portion of the respective lock pin when the respective operating piece is set at its original position is inclined downwardly towards the cam groove, so that, when the two operating pieces are pushed simultaneously, the top end portions of the lock pins move over the cam protrusions and the cam protrusions are protected from damage and the top end portions of the lock pins are not deformed.

Another embodiment of a dual push-push type switch device of the present invention will be described with reference to FIGS. 5 and 6.

Figure 5:
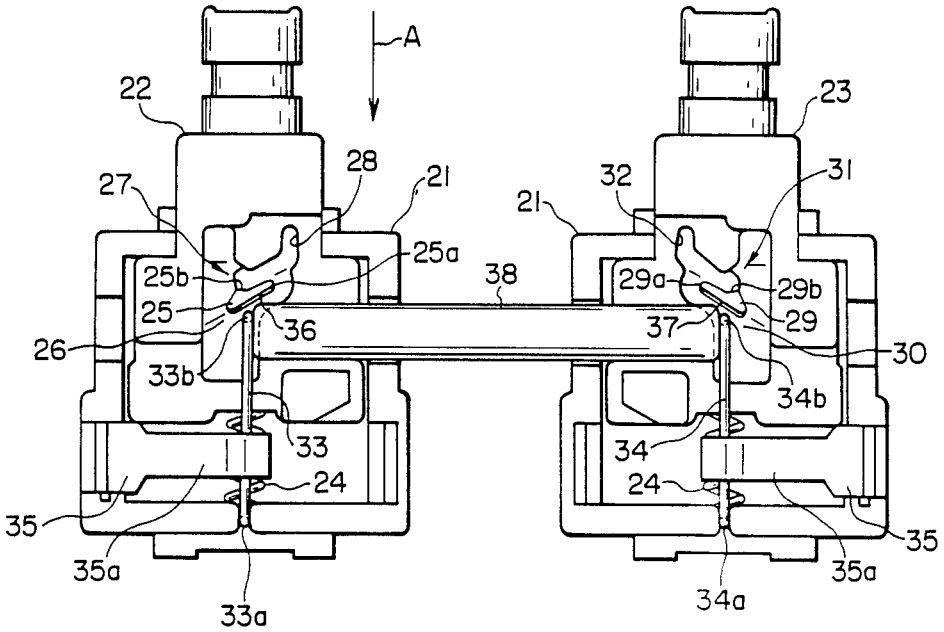
FIG. 5 is a front view of another embodiment of the switch device of the present invention.

In FIG. 5, a pair of box-shaped bases 21 are juxtaposed in a casing with a pair of operating pieces 22, 23. The lower half of each of the operating pieces 22 and 23 is received in a respective base 21, and the upper half protrudes through the upper wall of the base 21 and extends above the base 21. The operating pieces 22 and 23 can be pushed in the direction of the arrow A.

A compression coil spring 24 is interposed between each of the operating pieces 22, 23 and the lower wall of the respective base 21. The operating pieces 22 and 23 are urged upwardly by the coil springs 24 so as to be set at their original positions.

Figure 6:
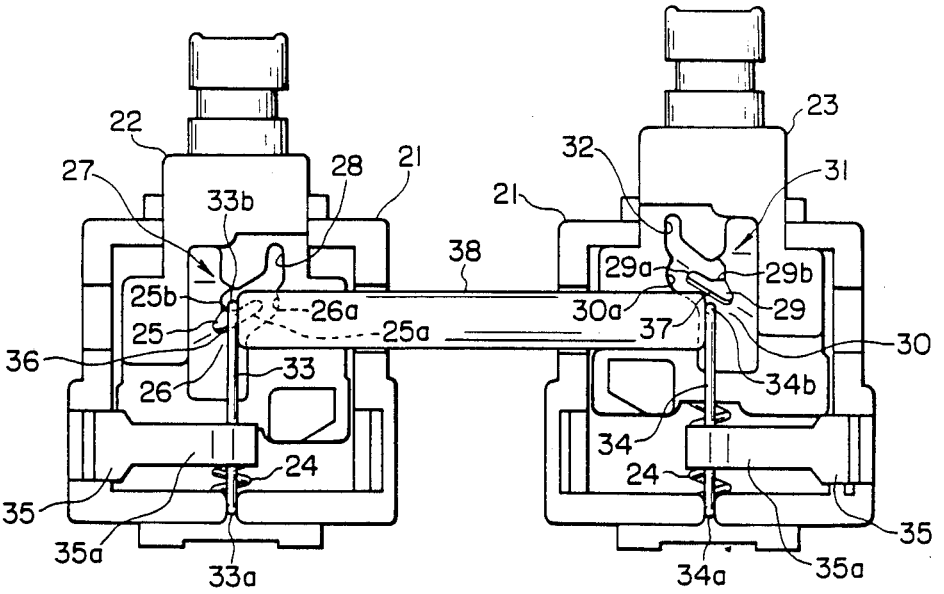
FIG. 6 is another front view of the switch of FIG. 5 showing a result of the operation thereof.

As shown in FIG. 6, the left operating piece 22 has a so called heart-shaped cam part 27 on its front side. The cam part 27 has a substantially heart-shaped cam groove 26 around a cam protrusion 25. The cam protrusion 25 has a sloped part 25*a* which protrudes in such a manner that its inclination increases upwards to the right. An engaging part 25*b* extends substantially to the left of the sloped part 25*a*. An auxiliary groove 28 extends from the cam groove 26 upwardly in such a manner that its left edge is flush with the right edge of the cam protrusion 25 or located slightly on the right side of the right edge of the cam protrusion 25.

Similarly, the right operating piece 23 has a cam part 31 on its front side. The cam part 31 is symmetrical with the cam part 27. That is, the cam part 31 is heart-shaped including a cam protrusion 29 and a substantially heart-shaped cam groove 30 around it. The cam protrusion 29 has a sloped part 29*a* which protrudes in such a manner that its inclination increases upwards to the left. An engaging part 29*b* extends substantially to the right. An auxiliary groove 32 extends from the cam groove 30 upwardly in such a manner that its right edge is flush with the left edge of the cam protrusion 29 or located slightly on the left side of the left edge of the cam protrusion 29.

A pair of lock pins 33, 34 confront the cam parts 27 and 31, respectively. Each lock pin is formed by bending the upper and lower end portions of a metal wire so that it is substantially U-shaped. The lock pins 33 and 34 are so arranged that the lower end portions, namely, base end portions 33*a* and 34*a* thereof, are inserted into the lower walls of the bases 21 and the upper end portions, namely, top end portions 33*b* and 34*b*, are movable along the cam grooves 26 and 30 of the cam parts 27 and 31, respectively.

Leaf springs 35 are mounted on the lower end portions of the side walls of the bases 21. The end portions 35*a* of the leaf spring 35 abut against the middle parts of the lock pins 33 and 34, respectively, so that the lock pins 33 and 34 are pushed towards the operating pieces 22 and 23 and in a direction toward to each other by the leaf springs 35.

When the operating pieces 22 and 23 are held at the original positions, the top end portions 33*b* and 34*b* of the lock pins 33 and 34 are positioned below the cam protrusions 25 and 29, respectively. Upon depression of the operating pieces 22 and 23, the cam actions of the cam parts 27 and 31 cause the top end portions 33*b* and 34*b* to move along the cam grooves 26 and 30 and to engage with the engaging parts 25*b* and 29*b*, to maintain the operating pieces 22 and 23 pushed. When the operating pieces 22 and 23 are pushed again, the top end portions 33*b* and 34*b* are disengaged from the engaging parts 25*b* and 29*b*, so that the operating pieces 22 and 23 are returned to the original positions.

Sloped surfaces 36 and 37 are formed in the parts of the peripheral surfaces of the cam protrusions 25 and 29 which confront the top end portions 33*b* and 34*b* of the lock pins 33 and 34 when the operating pieces 22 and 23 are set at the original positions. The sloped surfaces 36 and 37 extend upwards to the right and upwards to the left, respectively. The top end portions 33*b* and 34*b* of the lock pins 33 and 34 are also inclined in the same direction as the sloped surfaces (see FIG. 1).

Further in FIG. 5, a bar-shaped operating member 38 is set between the lock pins 33 and 34 in such a manner that it is movable to the right and left therebetween. The right and left ends of the member 38 abut against the top end portions 33*b* and 34*b* of the lock pins 33 and 34. Stationary contacts (not shown) are provided on the inner surfaces of the rear walls of the bases 21 and movable contacts (not shown) are provided on the rear surfaces of the operating pieces 22 and 23 so as to be moved into and out of engagement with the stationary contacts. That is, the stationary and movable contacts form switches. These switches are turned on only when the operating pieces are held at the pushed positions.

The operation of the dual push-push type switch device of this construction will be described.

When the operating pieces 22 and 23 are held at the original positions as shown in FIG. 5, the operating piece 22 may be depressed in the direction of the arrow A to turn the lock pin 33 about its base end portion 33*a*. That is, the top end portion 33*b* is moved from below the cam protrusion 25 along the cam groove 26 towards the upper right side of the cam protrusion 25 while pushing the operating member 38 to the right. The portion 33*b* enters the auxiliary groove 28 when the operating pieces 22 is pushed maximally. Upon release of the operating piece 22, the operating piece 22 is slighly returned in the direction opposite to the direction of the arrow A by the elastic force of the compression coil spring 24. The top end portion 33*b* of the lock pin 33 is engaged with the engaging part 25*b* of the cam protrusion 25. As a result, the operating piece 22 is held at the pushed position by the lock pin 33.

When, under this condition, the operating piece 22 is pushed again, the top end portion 33*b* of the lock pin 33 is disengaged from the engaging part 25*b* of the cam protrusion 25, as a result of which it is moved upwards to the left along the cam groove 26. Upon release of the depression of the operating piece 22, the piece 22 is returned to the original position by the elastic force of the compression coil spring 24 while the top end portion 33*b* of the lock pin 33 is moved along the cam groove 26 and returned to below the cam protrusion, as shown in FIG. 5.

The case where one of the operating pieces, the operating piece 22 for instance, is held at the pushed position and the other operating piece 23 is operated will be discussed with reference to FIG. 6.

When, under the condition shown in FIG. 6, the operating piece 23 is pushed, the top end portion 34*b* of the right lock pin 34 is moved along the cam groove 30 from below the cam protrusion 29 while pushing the operating member 38. The operating member 38 is moved to the cancel position when the top end portion 34*b* reaches the left edge 30*a* of the cam groove 30. As a result, the top end portion 33*b* of the left lock pin 33 is pushed to the left, thus being forcibly disengaged from the engaging part 25*b* of the cam protrusion 25. When, under this condition, the operating piece 23 is further pushed, the top end portion 34*b* of the lock pin 34 is engaged with the engaging part 29*b* of the cam protrusion 29, so that the operating piece 23 is held at the pushed position by the lock pin 34.

When the two operating pieces 22 and 23 are pushed simultaneously, the top end portions 33*b* and 34*b* of the right and left lock pins 33 and 34 move along the cam grooves 26 and 30, respectively, from below the cam protrusions 25 and 29, so that the top end portions 33*b* and 34*b* are held in balance with the operating member 38 being pushed by the lock pins 33 and 34. When under this condition, the operating pieces 22 and 23 are further pushed, the top end portions 33*b* and 34*b* of the lock pins 33 and 34 are moved over the protrusions 25 and 29 with the aid of the sloped surfaces 36 and 37 thereof and the inclined top end portions 33*b* and 34*b*. Therefore, the cam protrusions 25 and 29 will not be damaged and the top end portions 33*b* and 34*b* of the lock pins 33 and 34 will not be deformed.

When, under the condition shown in FIG. 6, the operating piece 23 is pushed abruptly, the top end portion 34*b* of the right lock pin 34 is moved over the cam protrusion 29 with the aid of the sloped surface 37 of the cam protrusion 29 and the bent top end portion 34*b*, and goes into the auxiliary groove 32 when the operating piece 23 is pushed maximally. When the top end portion 34*b* of the lock pin 34 moves over the cam protrusion 29, it is not moved along the left edge of the cam protrusion 29 yet, and therefore the operating member 38 is not displaced to the cancel position. However, when the top end portion goes into the auxiliary groove 32, the operating member 38 is displaced to the left cancel position because the auxiliary groove 32 is flush with the left edge of the cam protrusion 29 or is located on the left side of the left edge. As a result, the left lock pin 33 is forcibly disengaged from the cam protrusion 25, so that the operating piece 23 is returned to the original position.

In the above-described embodiment, the auxiliary grooves 28 and 32 are so positioned that, when the top end portions 33*b* and 34*b* of the lock pins 33 and 34 go into the auxiliary grooves 28 and 32, respectively, the operating member 38 is displaced to the cancel positions by the lock pins 33 and 34, respectively. Therefore, even if the right operating piece 23 is pushed abruptly while the left operating piece 22 is being held at the pushed position, the top end portion 34*b* of the lock pin 34 for the operating piece 23 is moved over the cam protrusion 29 without moving along the cam groove 30. The operating member 38 is displaced to the left to the cancel position when the top end portion 34*b* goes into the auxiliary groove 32. As a result, the left lock pin 33 is positively disengaged from the cam protrusion 25. Thus, both of the operating pieces 22, 23 are not held at the push positions simultaneously; that is, both of the operating pieces are not locked simultaneously.

As is apparent from the above description, according to the second embodiment of the present invention, each auxiliary groove for receiving the top end portion of a corresponding lock pin when the operating piece is pushed maximally is so positioned that, the operating member is displaced to the cancel position by the lock pin. Therefore, even when one of the operating pieces is abruptly pushed while the other operating piece is being held at the pushed position, the lock pin for the operating piece pushed is moved over the cam protrusion without moving along the cam groove, the difficulty that the two operating pieces are held at the pushed positions simultaneously is prevented.

It should be understood that the present invention is not limited to the particular embodiment described, but rather is susceptible to modifications, alternations, and equivalent arrangements within the scope of the appended claims.

What is claimed is:

1. A switch device comprising:

a first base and a first operating piece having a portion received in said first base, said first operating piece being movable with respect to said first base between an actuated position and a release position;

a second base and a second operating piece having a portion received in said second base, said second operating piece being movable with respect to said second base between an actuated position and a release position;

means for biasing said first operating piece relative to said first base and said second operating piece relative to said second base to said respective release positions therefor;

a first cam part on said first operating piece including a first cam protrusion and a first cam groove, said first cam protrusion having a first cam surface inclined obliquely;

a second cam part on said second operating piece including a second cam protrusion and a second cam groove, said second cam protrusion having a second cam surface inclined obliquely;

a first lock pin having a first base portion received in said first base and a first top end portion adapted for movement in said first cam groove and engagement with and movement along said first cam surface during movement of said first operating piece between said release position and said actuation position thereof;

a second lock pin having a second base portion received in said second base and a second top end portion adapted for movement in said second cam groove and engagement with and movement along said second cam surface during movement of second operating piece between said release position and said actuated position thereof;

an operating member having a first end in abutment with said first lock pin and a second end in abutment with said second lock pin, said operating member for biasing said lock pin of one of said operating pieces to disenage said top end portion thereof from said cam protrusion of said cam part associated with said lock pin in response to the movement of the other of said operating pieces from said release position to said actuated position thereof; and damage proof means for allowing said top end portion of said lock pin to move over said cam protrusion of said cam part.

2. A switch device according to claim 1, wherein said first cam part further includes a first auxiliary groove extending upwardly from said first cam groove.

3. A switch device according to claim 2, wherein said second cam part further includes a second auxiliary groove extending upwardly from said second cam groove.

4. A switch device according to claim 1, wherein said damage proof means includes said first top end portion of said first lock pin including a sloped portion for engagement with said first cam surface and said second top end portion of said second lock pin including a sloped portion for engagement with said second cam surface.

5. A switch device according to claim 1, wherein said damage proof means includes said first cam surface sloped toward said first lock pin, and said second cam surface sloped toward said second lock pin.

6. A switch device according to claim 1, wherein said biasing means comprises a first spring interposed between said first base and said first operating piece and a second spring interposed between said second base and said second operating piece.

* * * * *